United States Patent [19]

Jones

[11] 4,085,783

[45] Apr. 25, 1978

[54] PROCESS AND APPARATUS FOR LOOSENING BARK FROM LOGS

[76] Inventor: Charles A. Jones, 26 Gladstone Ave., Oshawa, Ontario, Canada

[21] Appl. No.: 727,117

[22] Filed: Sep. 27, 1976

Related U.S. Application Data

[63] Continuation of Ser. No. 544,547, Jan. 27, 1975, abandoned, which is a continuation-in-part of Ser. No. 510,942, Oct. 2, 1974, abandoned.

[30] Foreign Application Priority Data

Oct. 3, 1973 United Kingdom ..... 47157/73

[51] Int. Cl.[2] ..... B27L 1/00

[52] U.S. Cl. ..... 144/208 R; 144/311; 100/37; 100/95; 100/131

[58] Field of Search ..... 34/70, 85, 143; 144/309 R, 311, 208 R; 100/37, 38, 42, 131, 95

[56] References Cited

U.S. PATENT DOCUMENTS

| | | | |
|---|---|---|---|
| 163,403 | 5/1875 | Pfeffer | 34/143 |
| 1,403,072 | 1/1922 | Cheney | 100/131 X |
| 1,677,963 | 7/1928 | Ford | 34/143 X |
| 2,576,966 | 12/1951 | Pauley | 144/311 |
| 2,963,960 | 12/1960 | Pirie | 100/131 X |

FOREIGN PATENT DOCUMENTS

| | | | |
|---|---|---|---|
| 932,677 | 7/1963 | United Kingdom | 100/38 |

OTHER PUBLICATIONS

Appleton Wis. Inst. of Paper Chemistry, Bibliographic Series No. 190, Supplement II, Entry 210, 1972 (Simonov).

Appleton Wis. Inst. of Paper Chemistry, Bibliographic Series No. 190, Revision 79, 1960, Entry 778 (Wultsch).

*Primary Examiner*—Gary L. Smith

*Attorney, Agent, or Firm*—Ladas, Parry, Von Gehr, Goldsmith & Deschamps

[57] ABSTRACT

The invention provides processes and apparatus for removing bark from logs. The logs are subjected to mechanically applied compression forces acting against the sides of the logs, these forces being such as to expel juices from the ends of the logs. The pressure on a log is preferably between 500 and 3,000 p.s.i. per square inch measured on the area of the diametrical plane of the log. This compression provides loosening the bark which can then be readily removed. Preferably, a stack of logs is simultaneously compressed by means of a hydraulic press, and the juices which are expelled from the ends of the log are collected for sale as a by-product. The loosened bark on the log is then removed by a mechanical frictional treatment.

4 Claims, 7 Drawing Figures

Figure 1:
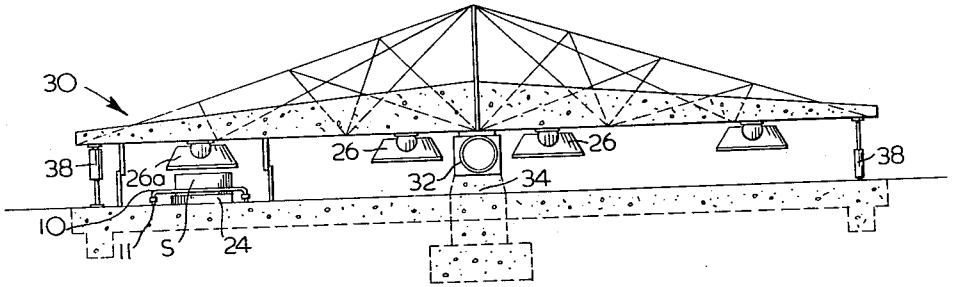

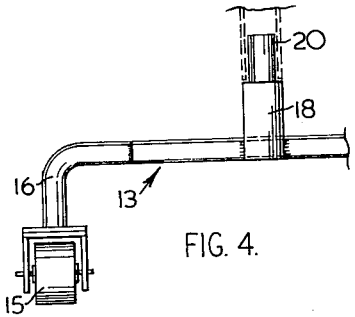
FIG. 4.
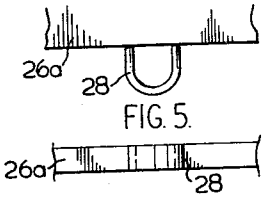
FIG. 5.
FIG. 5a.
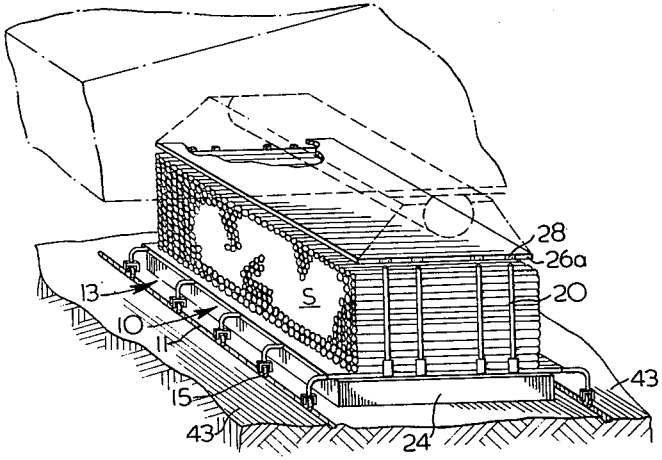
FIG. 3.

PROCESS AND APPARATUS FOR LOOSENING BARK FROM LOGS

This is a continuation of application Ser. No. 544,547, filed Jan. 27, 1975, now abandoned, which is a continuation-in-part of U.S. application Ser. No. 510,942, filed Oct. 2, 1974, now abandoned.

This invention relates to the removal of bark from logs and especially provides a process and apparatus which loosens the bark, enabling its easy removal, and simultaneously obtains from the logs useful juices.

Many ways of removing bark from logs are of course already known, but these suffer from various drawbacks, namely the need for complicated machiney, the need for substantial supply of power, and the fact that they do not enable the best use of the wood and bark to be made.

In the wood pulp industry, the usual method of debarking is to supply the logs to the upper end of a sloping rotating drum which is provided with internal blades. The logs are tumbled in the drum with a considerable amount of water, and the bark is removed by the action of the blades, and of the logs on each other. An important drawback of this process, and of some other processes which use water, is that the bark when removed is soaking wet, and so cannot be burnt at least without the addition of fuel to support combustion, so that disposing of the bark in this way is relatively expensive. In fact, burning presents such a problem that in many cases the bark is buried, or used as land fill, but the latter of course represents a polution problem.

In U.S. Pat. No. 2,741,283 to Alexander (issued Apr. 10, 1956), there is described a debarking method in which logs are placed in a pressure vessel and subjected to a fluid pressure of at least 100 p.s.i., steam being the preferred fluid for this process. The major drawback of this process is the requirement for a pressure vessel, which restricts the output obtainable with this method, and the length of logs which can be treated is also limited.

In accordance with one aspect of the present invention, a process for removing bark from logs includes the step of subjecting the logs to mechanically applied compressive forces acting against the sides of the logs, these forces being such as to expel juices from the ends of the logs. Preferably, the compressive forces acting on a log divided by the area of the diametrical plane of the log represents a pressure of between 500 and 3,000 pounds per square inch. For softwoods, pressures between 900 and 2,000 p.s.i. are generally satisfactory, the high pressures being advantageous in extracting more juice. Higher pressures, up to 3,000 p.s.i., are required for hardwoods.

This process has the effect of loosening the bark, after which the bark can readily be removed by simple mechanical means, or, on a small scale, by hand.

In contrast to the Alexander method, the force applied is not a hydrostatic force such as would subject each part of the log exterior to the same pressure, but the force is a mechanically applied force which acts on the sides of the logs to squeeze them, without the ends of the logs being subjected to any pressure. The term "mechanically applied compressive forces" will be understood as meaning a squeezing action applied to the sides of the logs without any substantial pressure being applied to the ends of the logs. This is an important difference over the Alexander process, because mechanical compression of this kind will cause the juices in the wood, namely the sap, resin, etc., to be squeezed out of the ends of the logs. This cannot happen in a process of the type described by Alexander, in which all the surfaces of the logs, including the ends, are subjected to the same fluid pressure, such as would prevent any outflow of juices. It is the flow of juices out of the logs which is believed to be responsible for the loosening of the bark, since it appears that juices flowing along the surface of the wood, underneath the bark, cause the loosening. Since the volume of juice flowing increases with the length of the log (assuming that logs of the same diameter are being considered), better results are achieved with fairly long logs, and in fact the process is not very satisfactory with logs less than say 18 inches in length. The process is satisfactory with logs up to 24 inches in diameter.

Preferably, a fairly large number of logs are treated simultaneously, by being pressed between platform means and a pressure member which may be a part of a hydraulic press. Thus, apparatus in accordance with the invention preferably comprises platform means for supporting a stack of logs in a pressure applying station, a pressure member and means for causing said pressure member to descend forcefully on the stack to subject the logs to compressive forces sufficient to expel juices therefrom, and the apparatus also preferably includes means for directing flow of said juices to a collection tank.

Advantageously, the platform means is part of a vehicle or truck, which can be used to transport the logs from a loading station to the pressure applying station, and then on to subsequent stations, without any unloading being necessary at the pressure applying station. With a suitable press of the type to be described, a load of 10 cords of logs can be treated at one pressing, which takes about 1 minute, and accordingly, the output achieved with this process is high.

The pressure member, and means for causing the pressure member to descend forcefully, preferably applies a compressive force on the logs of around 500 to 3,000 p.s.i., calculated as the total pressure applied to the stack divided by the area of the stack in plan view, assuming that the platform means and pressure applying member are substantially horizontal and assuming, as will normally be the case, that the logs are placed together side by side. Thus, each individual log in the stack, assuming that the logs are of roughly the same size, will be subjected to a pressure of between 500 and 3,000 p.s.i. approximately, calculated as the total force on each log divided by its area in the diametrical plane.

Preferably, the wood juices are collected for sale as a by-product. The resin obtained from pine is especially useful in the production of synthetic rubber. Unlike with many conventional processes, the removed bark is relatively dry, and can be used as a fuel by burning for example in steam boilers. Also, the bark can be impregnated with resin and used to produce wood panels in the process described in Canadian patent application No. 168,126 filed Apr. 6, 1973.

The best results are obtained with wood cut during the sap flowing seasons, i.e. green wood, although normal seasonal temperatures above freezing are also satisfactory for carrying out the process. If frozen, the wood must be thawed before the pressure is applied. If the wood is dry, it should be soaked until saturated.

Suitable woods include for example spruce, fir, pine, poplar, and cedar, and hardwoods including maple can also be used.

By way of example, a test was made of applying pressure to logs of freshly cut pine, balsam and spruce. One log was 4 inches in diameter, two were 3½ inch diameter and three pieces were 3 inches in diameter, all being 18 inches long. These were placed in a rectangular mould in 3 layers and a top was put on. Pressure was applied to the top by hydraulic means until a pressure of 925 pounds per square inch was reached (this being calculated as total force divided by the plan area of the stack). The time taken to reach this pressure was about 3 minutes and during this period the free liquids were seen to flow from the ends of the wood starting first between the bark and the wood, the flow gradually increasing as the wood compressed until the very center was squirting its liquid content. The logs were compressed to less than half their normal width.

Upon releasing the pressure the logs immediately began to expand until they reached their approximate former size and shape. The bark was by now loose and semi-dry and could be stripped off by hand. Only a few minutes was required for the whole operation.

In another test, four logs of black spruce wood, cut in July (and therefore having plentiful sap), were placed in a hydraulic press. The logs were 5 inches to 5½ inches in diameter, 24 inches in length, and weighed a total of 58 pounds. These logs were subjected to a total compressive force of 125 tons, this representing a pressure of 900 p.s.i. This produced approximately 136 fluid ounces of juices. Further tests indicated that with a pressure of 2,000 p.s.i. the total amount of juices obtained would be more than 170 fluid ounces.

Figure 2:
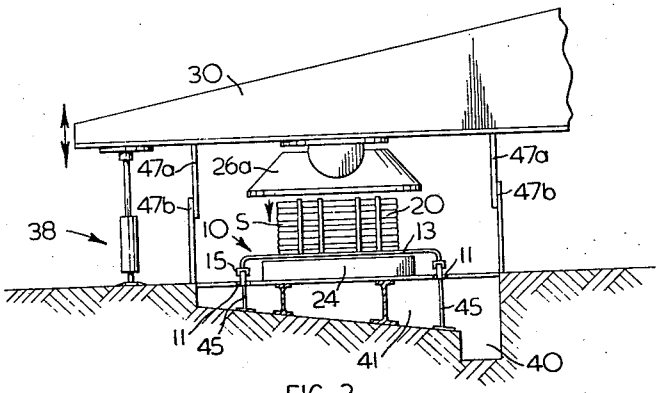
Figure 6:
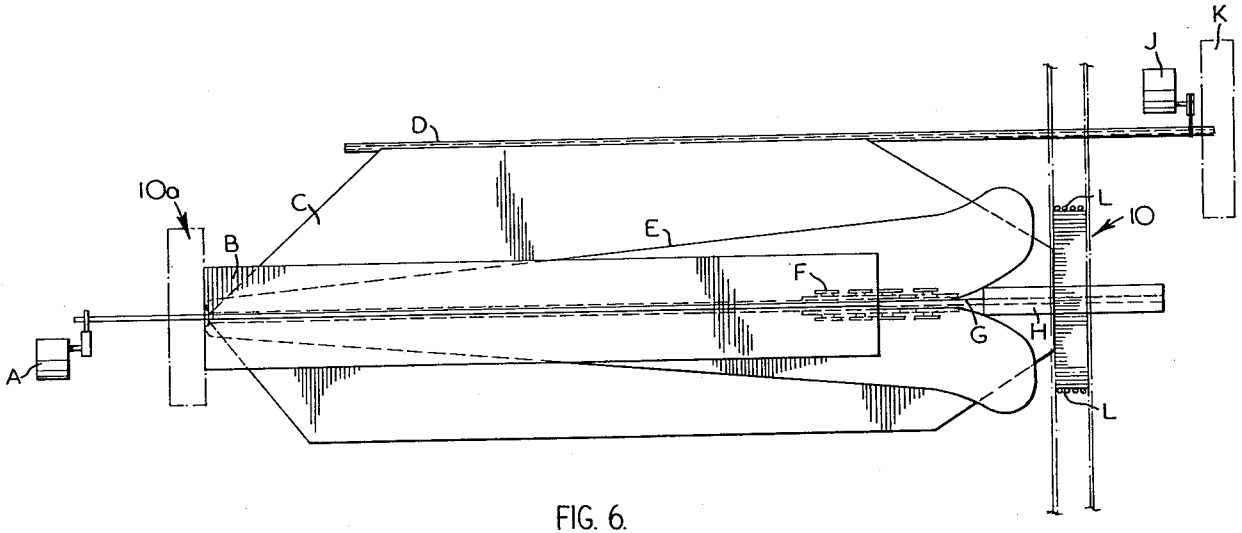

A preferred form of apparatus for carrying out the invention on a large scale will now be described by way of example by reference to the accompanying drawings, in which:

FIG. 1 is an elevation of a hydraulic press used in the process of this invention, FIG. 2 is an enlarged view of a part of the press shown in FIG. 1, FIG. 3 is a perspective view of a load of logs being pressed, with parts of the press shown in broken lines, FIG. 4 is a detail of the truck shown in FIG. 3, FIGS. 5 and 5*a* are respectively plan and side views of guide loops on the pressure head, FIG. 6 is a diagrammatic plan view of a de-barking station.

The apparatus shown in part of an integrated plant for producing the desired wood product, in this case moulded panels in accordance with Canadian patent application No. 168,126. In this plant, the logs are received in a loading station where they are loaded on to trucks 10 which are movable on rails 11 to carry the logs through various processing operations. The trucks (best shown in FIGS. 2 and 3) include beds or platforms 13, the platform being 40 foot in length and 8 foot in width, and having open sides. The platforms 13 are mounted on wheels 15 which are held by spring suspensions at the outer ends of legs 16 shown best in FIG. 4. The ends of the platforms are provided with a series of four spaced vertical guide posts 18, shown in FIGS. 3 and 4, which have upper end portions of reduced diameter suitable for removably receiving extension posts 20. The extension posts 20 will have a length chosen to suit particular job requirements, but in the embodiment shown the extensions are 4 feet high so that the maximum size of the stacks of logs which can be taken on the trucks is 40 ft. by 8 ft. by 4 ft., which corresponds to a load of 10 cords of logs, the logs being either 4 foot or 8 foot in length stacked so as to extend across the truck.

The debarking apparatus comprises in combination a pressure applying station for loosening the bark in accordance with the present invention which is shown in FIGS. 1 to 3, and 5, and apparatus for removing the loosened bark which is shown in FIG. 6. The pressure applying station comprises essentially a press base 24 for supporting the platform 13 of a truck, and a pressure member or head 26*a* with means for causing this member to descend forcefully on the top of a stack of logs held by the truck. The press base 24 is a strong structure positioned between the rails 11 and having supporting parts which are located just underneath the platform 13 when the load is suitably positioned under the pressure head. The pressure head is sized to fit over the top of the stack on the truck platform, sitting between the posts 20 at the ends of the truck, and having along its ends guide loops 28 (shown in FIGS. 5 and 5*a*) which locate on the posts 20. The head is preferably operated hydraulically to exert a strong downwards force on to the stack of logs on the truck this force being such as to produce a pressure of about 2,000 p.s.i. in the stack, calculated as indicated above; this requires a total force of about 50,000 tons.

Where, as shown, the debarking apparatus is used in a wood moulding plant as described in Canadian patent application No. 168,126, the pressure applying member is part of a large hydraulic press shown in FIG. 1 which also serves to compress the debarked logs in subsequent process operations described in the aforesaid application. These operations include a first compression carried out in such manner that subsequent expansion causes resin to be sucked into the logs, and a subsequent compression to mould the resin impregnated logs to desired shapes. The combined press for such a plant as shown has a large overhead beam 30 of concrete construction, pivoted about its center on a strong bearing 32 held by a rigid foundation member 34. The beam carries a number of spaced pressure heads 26 on each side of its center, these being pivotally attached to the beam so that they can remain horizontal as the beam pivots. A series of hydraulic cylinders 38 are connected to each end of the beam to cause this to rock about its pivot. The rails 11 carrying trucks 10 from the loading station pass under one of the pressure heads 26*a* as shown at the left hand side of FIG. 1, and when the truck is suitably positioned the beam can be rocked by the hydraulic cylinders 38 to bring the appropriate pressure head 26*a* forcefully down onto the stack of logs.

The pressing station includes a collection tank or sump 40 which forms the lowest part of a pit 41 which surrounds the whole area of the pressing station on both sides of rails 11, as shown in FIG. 2. A grating 43 provides a deck at floor level above the pit 41, and steel supports 45 extend upwardly from the base of pit 41 to support rails 11 and the press base 24. The sides of the pressing station are closed by sheet metal splashguards each having an upper part 47*a* fixed to the beam 30 and a lower part 47*b* fixed to the floor, the two parts engaging slidably as the beam is rocked.

With the truck 10 positioned as described and as shown in FIGS. 1 to 3, pressure is gradually applied to the logs by head 26*a* by rocking the beam 30 by means of cylinders 38. After a relatively small amount of force has been applied, the spring suspensions of the truck wheels compress to bring its platform 13 into contact with the press base 24 between the rails, after which this supports the platform so that there is no undue force applied to the wheels or bearings of the truck. The pressing operation continues until the required pressure has been produced in the logs, during which juices squirt from the logs and flow off the sides of the truck platfom, through grating 43 and into pit 41 and which is arranged to collect the juices and direct these to the sump 40. The whole pressing operation takes about 1 minute.

The pressed logs, with their bark loosened but still in place, pass on the trucks to a debarking station at which the loosened bark is readily removed by mechanical friction means, and such debarking apparatus may take many forms as will be apparent to a person skilled in the art. In a prefered form of apparatus as shown in FIG. 6 the logs are unloaded from the truck 10 at the right hand side of FIG. 6 and passed into the apparatus longitudinally, the logs being fed through the apparatus by drag chain G driven by unit A while rollers or tumblers F with roughened surfaces contact the sides of the logs and an overhead, floating B pressure plate with a rough underside contacts the top of the logs. The logs are fed automatically off the trucks, being fed off longitudinally from the center of the stack on the trucks by a vertical feed paddle H which pushes the logs off the trucks into the drag chain. Simultaneously, pushers L act on the logs at both ends of the truck 10 to push the logs towards the center and into the feed paddle. Bark removed by the rollers and pressure plate pass through finned guides E into a catch tray C and is removed by a further drag chain operating in chute D. The debarked logs are automatically loaded onto truck 10*a* at the left hand side of FIG. 6.

The removed bark, which is generally dry, is a useful fuel for use in the plant. One important use for such fuel is during the winter, when it is required to thaw out frozen logs, which must be thawed before they can be successfully debarked in accordance with the method described. Bark may also be retained in the truck K shown in FIG. 6 for moulding into special panels.

Instead of forming part of a wood processing plant as described, apparatus in accordance with this invention for loosening bark by applying pressure may be used on site where the wood is being cut. In this case, the removal of the juices from the logs will reduce the weight of the logs by about 25%, so saving considerably on the transport costs to the plant. If the pressure applying station is combined with a debarking station so that bark is also removed on site then of course there is an additional saving.

In addition to the advantages described above, it is found that the debarked logs produced by this process are much cleaner than logs debarked by conventional processes, since such logs have been tumbled against the bark of other logs and have picked up various dirt in this way. Furthermore, the pressing operation removes tar from spruce, and this is particularly advantageous in the pulping industry, since this tar must be removed in any case before the wood produces a useful pulp.

I claim:

1. Apparatus for debarking of logs, including a loading station, a pressure applying station and a debarking station, and platform means for carrying a stack of logs, said platform means being mounted on wheels via spring suspension means for movement of said stack from the loading station to the pressure applying station and subsequently to said debarking station, said pressure applying station including means for supporting said platform means independently of said wheels and a pressure member with means for causing said pressure member to descend forcefully on a stack of logs on said platform means to subject the sides of the logs to compressive forces sufficient to expel juices therefrom, and said debarking station including means for debarking logs the bark of which has been loosened in said pressure applying station.

2. Apparatus according to claim 1, wherein said means for causing the pressure member to descend is capable of causing said pressure member to apply a force on said stack of logs such that the force divided by the area of the stack in plan view is between 500 to 3,000 pounds per square inch.

3. Apparatus according to claim 1, further comprising a collection tank for juices, and means for directing said juices expelled from said logs in the pressure applying station into said collection tank.

4. Apparatus according to claim 1, wherein said pressure member is mounted on a pivoted beam, which beam also carries additional pressure means for performing compression of the debarked logs in a subsequent operation.

* * * * *